US007966955B2

(12) United States Patent
Niizeki

(10) Patent No.: US 7,966,955 B2
(45) Date of Patent: Jun. 28, 2011

(54) BORING DEVICE AND MULTI-NEEDLE EMBROIDERY SEWING MACHINE EQUIPPED WITH THE SAME

(75) Inventor: Tomoyasu Niizeki, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 365 days.

(21) Appl. No.: 12/289,511

(22) Filed: Oct. 29, 2008

(65) Prior Publication Data

US 2009/0107373 A1 Apr. 30, 2009

(30) Foreign Application Priority Data

Oct. 30, 2007 (JP) ..... 2007-281128

(51) Int. Cl.
*D05B 3/10* (2006.01)
*D05B 37/00* (2006.01)

(52) U.S. Cl. ..... 112/89

(58) Field of Classification Search ..... 112/84, 112/85, 89, 98–101, 129, 102.5; 223/104; 83/866, 660
See application file for complete search history.

(56) References Cited

U.S. PATENT DOCUMENTS

| | | | | | |
|---|---|---|---|---|---|
| 268,170 | A | * | 11/1882 | Baum | 112/89 |
| 881,894 | A | * | 3/1908 | Braun | 112/89 |
| 938,884 | A | * | 11/1909 | Moriggl | 112/89 |
| 5,555,834 | A | * | 9/1996 | Bonner | 112/129 |
| 2008/0229988 | A1 | | 9/2008 | Kishi | |

FOREIGN PATENT DOCUMENTS

| | | | | |
|---|---|---|---|---|
| CN | 1200161 | C | | 5/2005 |
| JP | U-58-4695 | | | 7/1981 |
| JP | U-63-81888 | | | 5/1988 |
| JP | U-63-85695 | | | 6/1988 |
| JP | A-6-81263 | | | 3/1994 |
| JP | 411043858 | A | * | 2/1999 |
| JP | A-2003-38881 | | | 2/2003 |
| JP | A-2008-229197 | | | 10/2008 |

* cited by examiner

*Primary Examiner* — Ismael Izaguirre
(74) *Attorney, Agent, or Firm* — Oliff & Berridge, PLC

(57) ABSTRACT

A boring device that can be attached to and detached from a lower end of one of a plurality of needle bars provided on a multi-needle embroidery sewing machine, and includes a boring knife that makes a cut in a work cloth and a first engagement portion to be engaged with a second engagement portion provided on the one of a plurality of the needle bars. The second engagement portion restricts horizontal rotation of the boring device, and a horizontal position of the boring knife with respect to the one of the needle bars is determined when the first engagement portion is engaged with the second engagement portion.

2 Claims, 16 Drawing Sheets

BORING DEVICE AND MULTI-NEEDLE EMBROIDERY SEWING MACHINE EQUIPPED WITH THE SAME

CROSS-REFERENCE TO RELATED APPLICATION

This application claims priority to Japanese Patent Application No. 2007-281128, filed Oct. 30, 2007, the disclosure of which is herein incorporated by reference in its entirety.

BACKGROUND

The present disclosure relates to a boring device that can be attached to and detached from a lower end of a needle bar of a multi-needle embroidery sewing machine, and makes a cut in a work cloth with a boring knife, and a multi-needle embroidery sewing machine equipped with the same.

Conventionally, for embroidering by using an embroidery sewing machine, a technique (eyelet embroidery) has been available to form a cut (hole) in a work cloth and embroider around the cut. The cut may be formed by a boring device. As disclosed in Japanese Laid-Open Utility Model Application No. 63-81888, for example, the boring device includes a boring knife having a cutting portion at an end thereof, and is configured so that the boring device can be attached to and detached from the embroidery sewing machine. To form a cut, a user attaches the boring device to a lower end of a needle bar. In this case, the user may adjust the position of the boring device so that the horizontal position of the attached boring knife may correspond to a prescribed position with respect to the needle bar. Then, the user may start embroidering using the embroidery sewing machine to form a cut by plunging the boring knife through a work cloth held by an embroidery frame while feeding the work cloth.

SUMMARY

With the above-described boring device, it may be troublesome for the user to adjust the boring knife to the prescribed position with respect to the needle bar. Further, in the case of a multi-needle embroidery sewing machine having a plurality of needle bars, the user needs to attach the boring device to a predetermined one of the plurality of needle bars. If the boring device is attached to a wrong needle bar, a cut cannot be formed at a desired position on a work cloth. As a result, an embroidery pattern cannot be formed at a desired position on the work cloth.

Various exemplary embodiments of the general principles herein provide a boring device that can be easily and appropriately attached to a multi-needle embroidery sewing machine and a multi-needle embroidery sewing machine equipped with the same.

Exemplary embodiments provide a boring device that can be attached to and detached from a lower end of one of a plurality of needle bars provided to a multi-needle embroidery sewing machine. The boring device includes a boring knife that makes a cut in a work cloth and a first engagement portion to be engaged with a second engagement portion provided on the one of a plurality of the needle bars. The second engagement portion restricts horizontal rotation of the boring device and a horizontal position of the boring knife with respect to the one of the needle bars is determined when the first engagement portion is engaged with the second engagement portion.

Exemplary embodiments further provide a multi-needle embroidery sewing machine that includes a plurality of needle bars, a second engagement portion provided on a predetermined needle bar of the plurality of needle bars, and a detachable boring device that is attached to a lower end of the predetermined needle bar. The boring device comprises a boring knife that makes a cut in a work cloth and a first engagement portion that is engaged with the second engagement portion. The second engagement portion restricts horizontal rotation of the boring device and a horizontal position of the boring knife with respect to the predetermined needle bar is determined when the first engagement portion is engaged with the second engagement portion.

BRIEF DESCRIPTION OF THE DRAWINGS

Exemplary embodiments of the disclosure will be described below in detail with reference to the accompanying drawings in which.

DETAILED DESCRIPTION OF THE EXEMPLARY EMBODIMENTS

The following will describe an exemplary embodiment of the present disclosure with reference to the drawings. The present embodiment is an example in which the present disclosure is applied to a multi-needle embroidery sewing machine 11 that has six needle bars. The multi-needle embroidery sewing machine 11 can perform sewing with six kinds of threads, each of which is supplied from a thread spool to a sewing needle attached to each of the needle bars.

Figure 1:
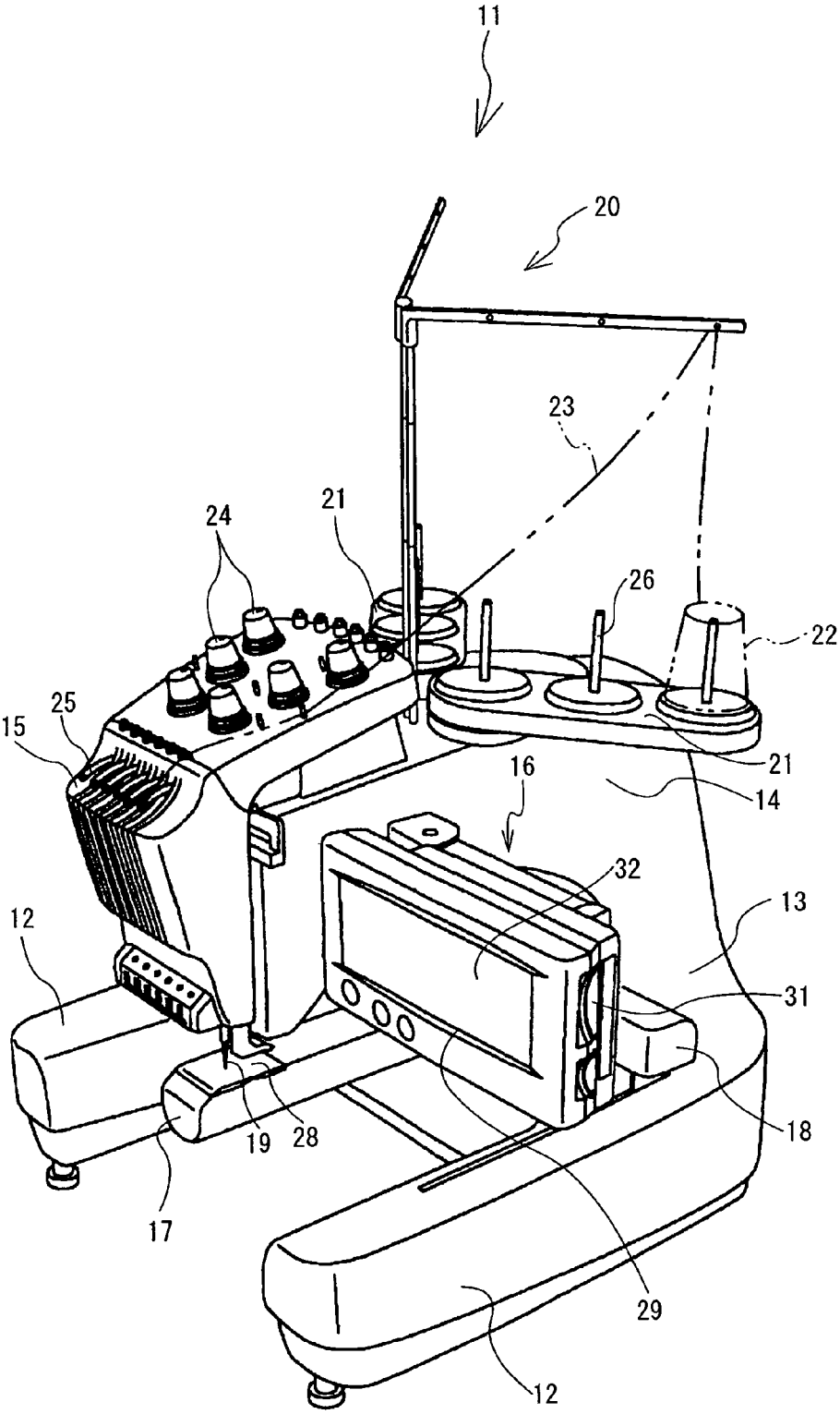
FIG. 1 is a perspective view of a multi-needle embroidery sewing machine.
Figure 2:
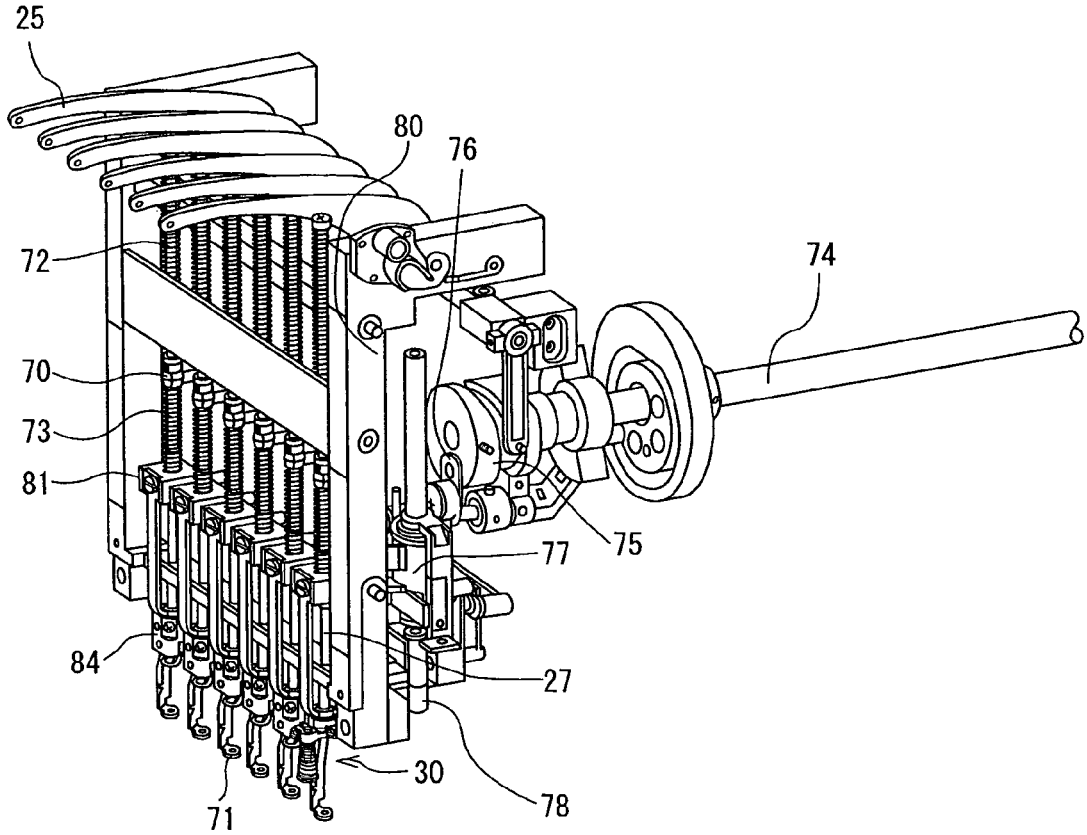
FIG. 2 is a perspective view of an internal configuration of a needle bar case of the multi-needle embroidery sewing machine.

The physical configuration of the multi-needle embroidery sewing machine 11 will be described below with reference to FIGS. 1 to 4. In the following description, the lower left and upper right sides of the page of FIGS. 1 and 2 are referred to as "front and rear sides of the multi-needle embroidery sewing machine 11," respectively. The right and left directions of the multi-needle embroidery sewing machine 11 as viewed from the user of the multi-needle embroidery sewing machine 11 are referred to as "right and left directions of the multi-needle embroidery sewing machine 11," respectively.

As shown in FIG. 1, the multi-needle embroidery sewing machine 11 includes a support portion 12 that supports the entirety of the multi-needle embroidery sewing machine 11, a pillar 13 that extends upward from the support portion 12, and an arm portion 14 that extends from the upper end of the pillar 13 toward the front side. At the end of the arm portion 14, a needle bar case 15 is mounted in such a manner as to be movable right and left. Although only one sewing needle 19 is shown for simplification in FIG. 1, the sewing needle 19 is attached to each of six needle bars contained in the needle bar case 15. When embroidery sewing is performed, first the needle bar case 15 moves right and left, thereby one needle bar 27 (see FIG. 2) to be driven up and down is selected, out of the six needle bars 27.

On the right side of the midsection of the arm portion 14 in the front and rear direction, an operating portion 16 is pivotally supported by the arm portion 14. The operating portion 16 includes a liquid crystal display (LCD) 29, a memory card connector 31, and a touch panel 32. The LCD 29 and the touch panel 32 may be used to enter a variety of commands to the multi-needle embroidery sewing machine 11. A memory card (not shown) may be inserted into the memory card connector 31.

Below the arm portion 14, a cylinder bed portion 17 is provided. The cylinder bed portion 17 extends from the lower end of the pillar 13 toward the front side. At the front part in the cylinder bed portion 17, a shuttle (not shown) and a shuttle drive mechanism (not shown) that drives the shuttle rotationally are provided. The shuttle may contain a bobbin (not shown) around which a lower thread is wound. Further, below the arm portion 14, an embroidery frame moving mechanism 18 is provided. The embroidery frame moving mechanism 18 moves an embroidery frame (not shown) right and left. In embroidery sewing, the embroidery frame (not shown) which holds a work cloth is set to a carriage of the embroidery frame moving mechanism 18. Embroidery sewing may be performed as the embroidery frame is moved back and forth and right and left by an X-axis motor (not shown) and a Y-axis motor (not shown).

A pair of right and left spool bases 21 are provided on the rear side of the upper surface of the arm portion 14. A thread spool pin 26 to which a thread spool 22 may be fitted protrudes from each of the thread spool bases 21. Three thread spools 22 can be mounted on each of the spool bases 21. In other words, a total of six thread spools 22, the same as the number of the sewing needles 19, can be mounted. A needle thread 23 pulled from each of the thread spools 22 mounted on the spool bases 21 is supplied to each of the sewing needles 19 via a thread guide mechanism 20 that prevents the needle thread 23 from being entangled, a tensioner 24 that adjusts the thread tension, and a thread take-up lever 25 that takes up the needle thread 23 by reciprocating up and down.

The internal configuration of the needle bar case 15 provided on the front side of the arm portion 14 will be described below with reference to FIGS. 2 to 4. The six needle bars 27 are contained in the needle bar case 15. Each of the needle bars 27 is allocated with a needle number to identify each of the needle bars 27. In the present embodiment, the needle bars 27 are allocated with needle bar numbers 1 to 6 in this order from the rightmost needle bar 27 in FIG. 2. As shown in FIG. 2, the needle bar 27 is supported so as to slide up and down, by a pair of upper and lower fixing members (not shown), which are fixed to a frame 80 of the needle bar case 15. Presser springs 72 and 73 are respectively provided to the upper portion and the lower portion of each of the needle bars 27. A needle bar bracket 70 is provided between the presser springs 72 and 73, and a presser bar bracket 81 is provided under the presser spring 73.

An engagement concave portion 271 (see FIGS. 11 and 12) is formed as a groove that extends upward from the lower end of each of the needle bars 27. As shown in FIG. 3, a needle clamp 84 is fixed to the lower end of each of the needle bars 27 with a setscrew (not shown). The base of the sewing needle 19 may be inserted into the engagement concave portion 271. The sewing needle 19 inserted into the engagement concave portion 271 may be pushed toward the engagement concave portion 271 and fixed by a needle setscrew (not shown) provided on the needle clamp 84. A presser foot 71 is disposed to the lower end of the needle bar 27. The presser foot 71 holds a work cloth intermittently in conjunction with the up-and-down movement of the needle bar 27.

Figure 3:
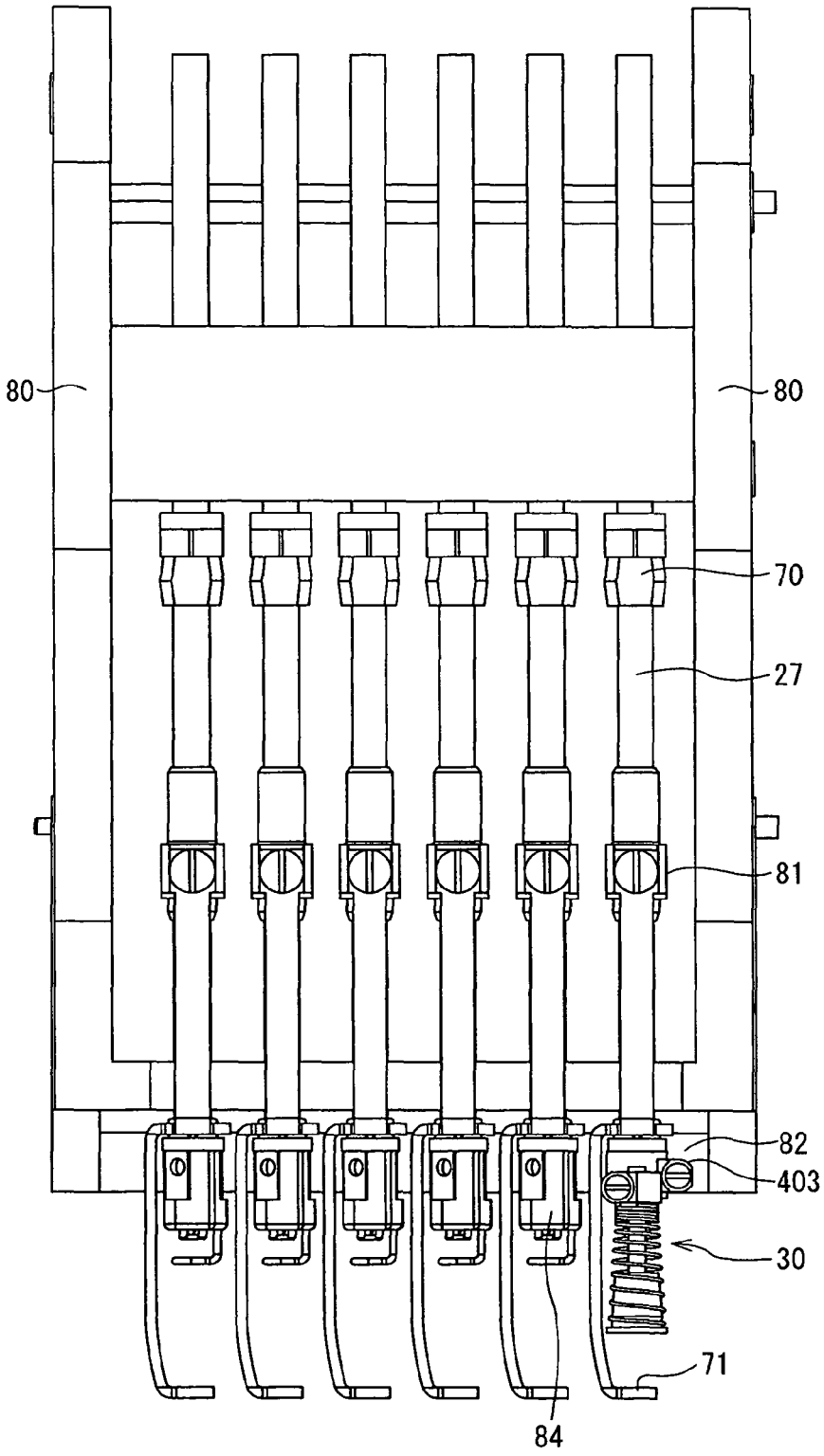
FIG. 3 is a front view of the internal configuration of the needle bar case.
Figure 4:
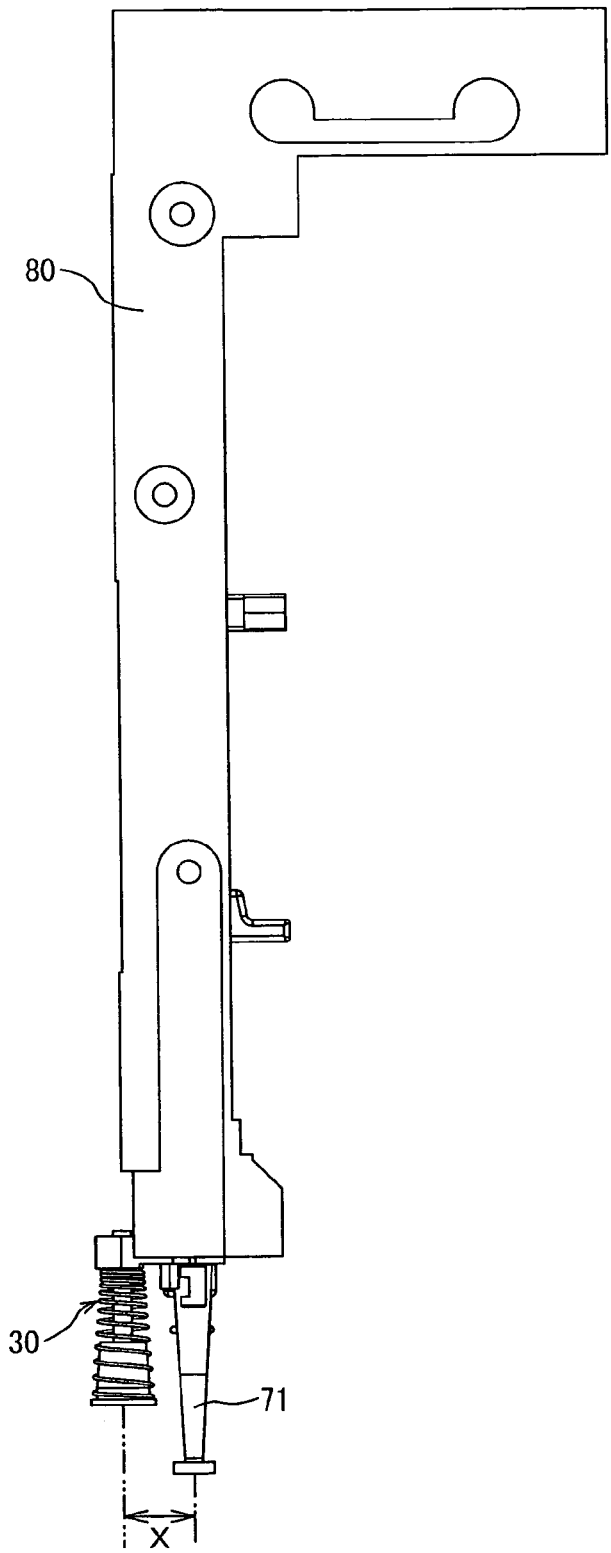
FIG. 4 is a right side view of the internal configuration of the needle bar case.

As shown in FIGS. 2 to 4, in place of the sewing needle 19, a boring device 30 may be attached to the needle bar 27. The boring device 30 may be used to make a cut called an eyelet, around which embroidery may be performed, in the work cloth. As described later, in the present embodiment, only the rightmost needle bar 27 in FIGS. 2 and 3 (the needle bar 27 having the needle bar number 1) is configured so that the boring device 30 can be attached to and detached from the needle bar 27. For simplification, FIGS. 2 and 3 show no sewing needle 19 attached to any of the needle bars 27 having needle bar numbers 2 to 6. However, at the time of embroidery sewing, the sewing needle 19 may be attached to each one of the needle bars 27 via the needle clamp 84. Further, the presser springs 72 and 73 are not shown in FIG. 3 for simplification.

Figure 5:
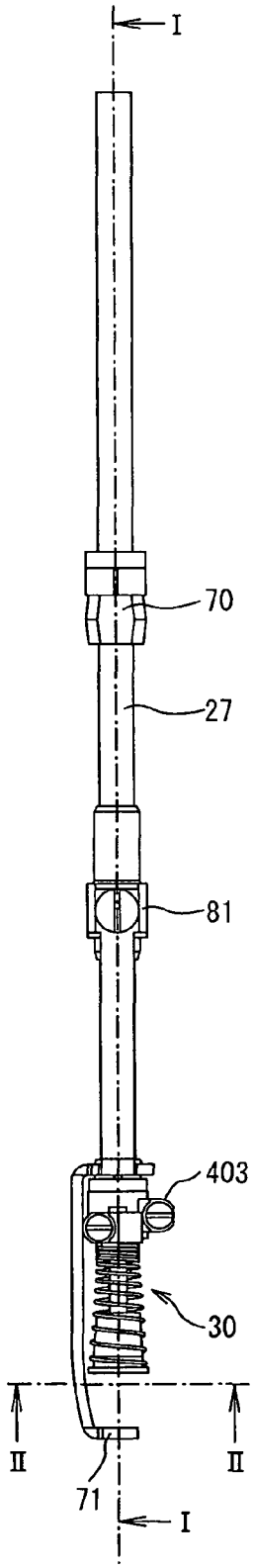
FIG. 5 is a front view of a boring device attached to a needle bar.
Figure 6:
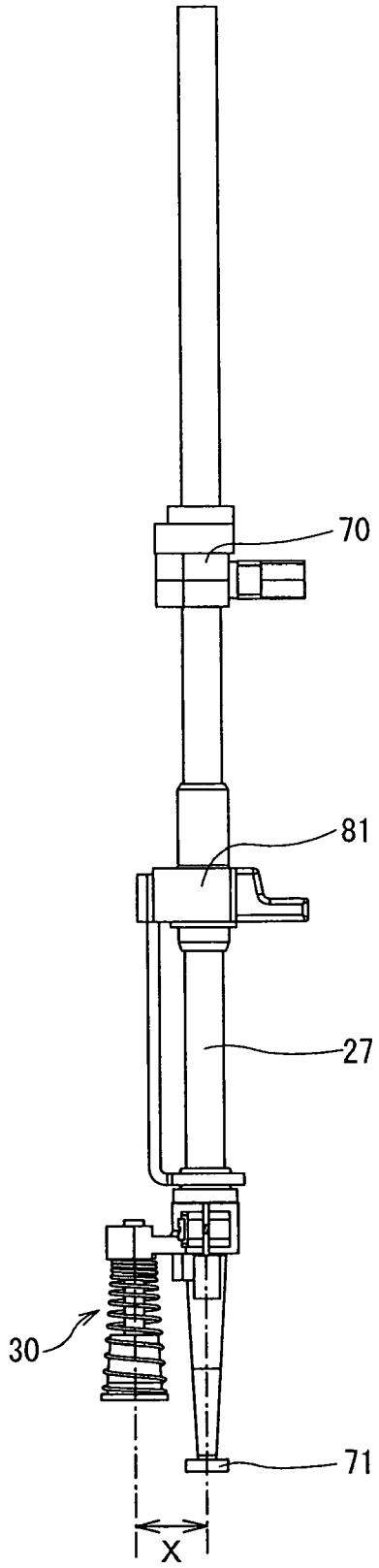
FIG. 6 is a right side view of the boring device attached to the needle bar.
Figure 7:
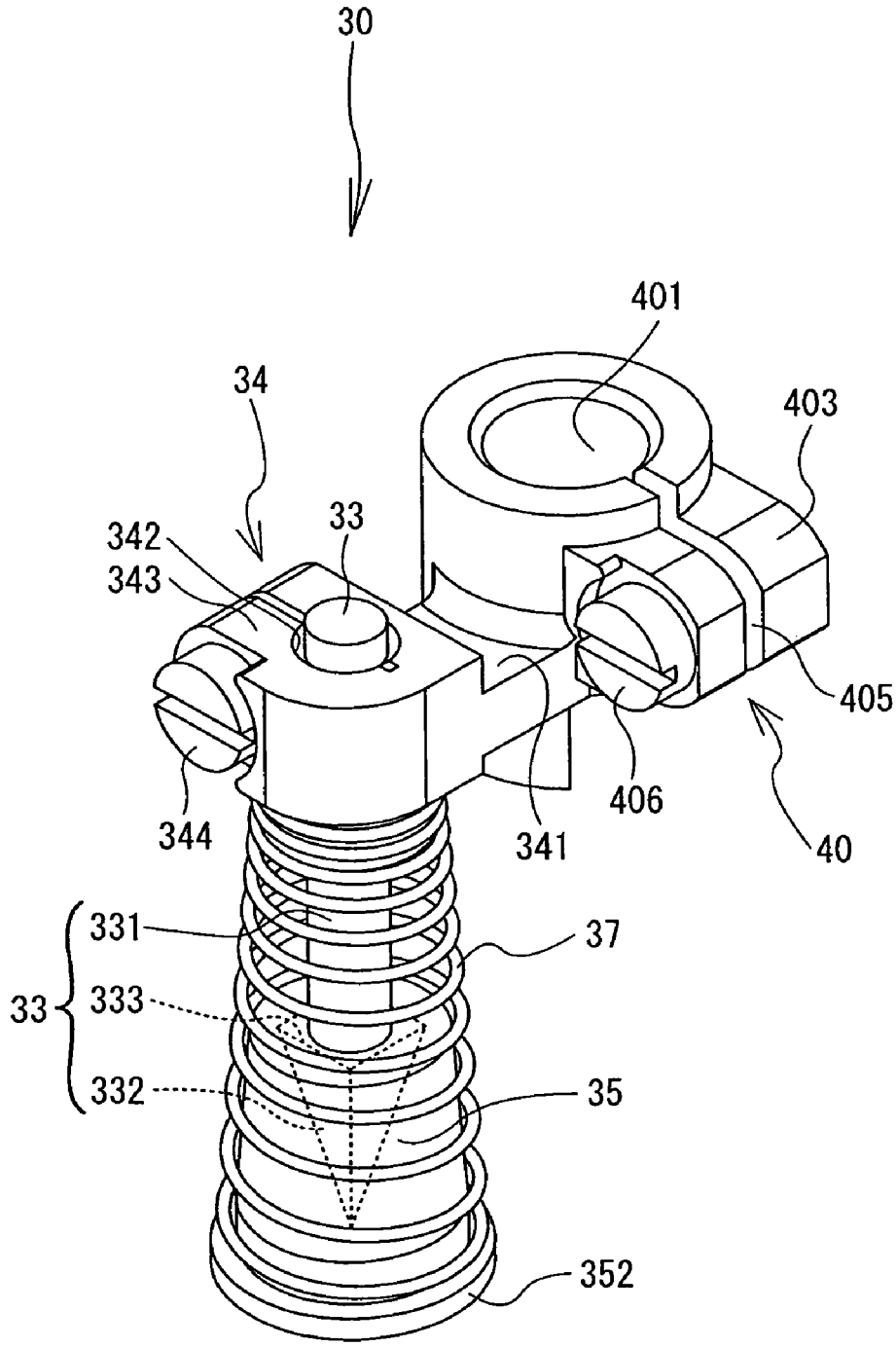
FIG. 7 is a perspective view of the boring device.

The configuration of the boring device 30 will be described below with reference to FIGS. 5 to 12. As shown in FIGS. 5 and 6, the boring device 30 may be attached to the lower end of the needle bar 27, after the needle clamp 84 fixed to the needle bar 27 with the needle bar number 1 (see FIGS. 2 and 3) is removed. As shown in FIG. 7, the boring device 30 includes an attachment portion 40, a boring knife 33, a holder 34, a presser 35, and a spring 37. These members of the boring device 30 will each be described in detail below.

Figure 9:
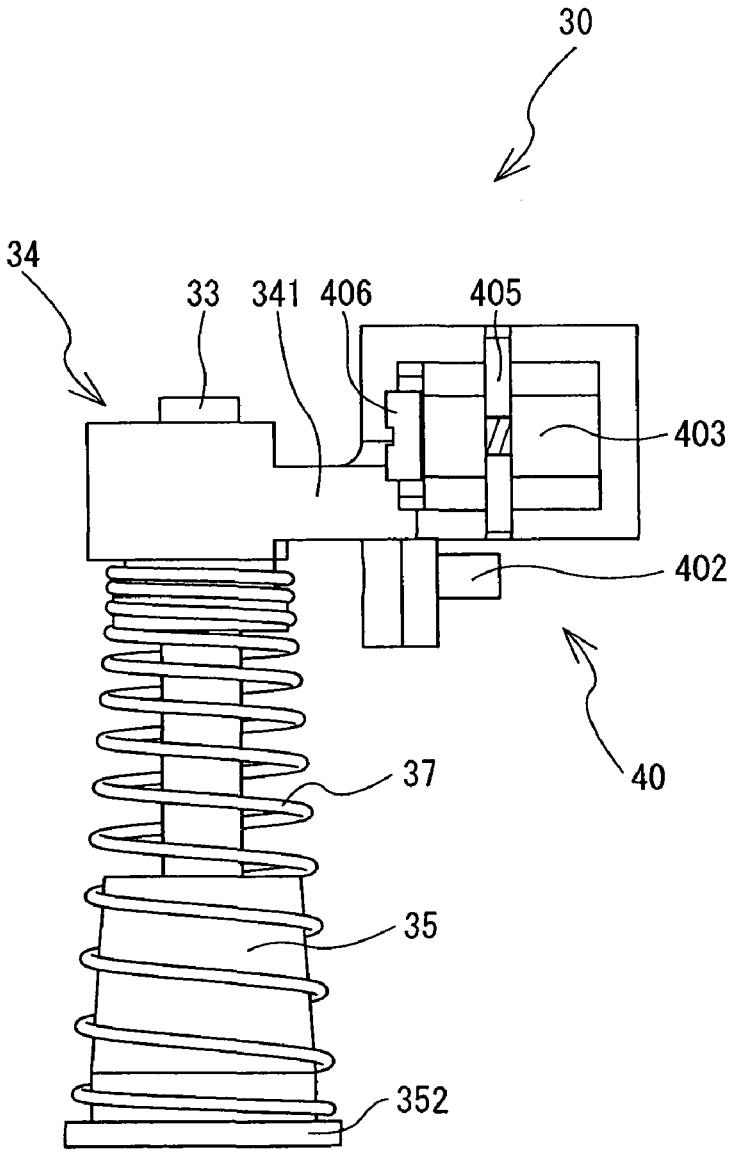
FIG. 9 is a right side view of the boring device.
Figure 10:
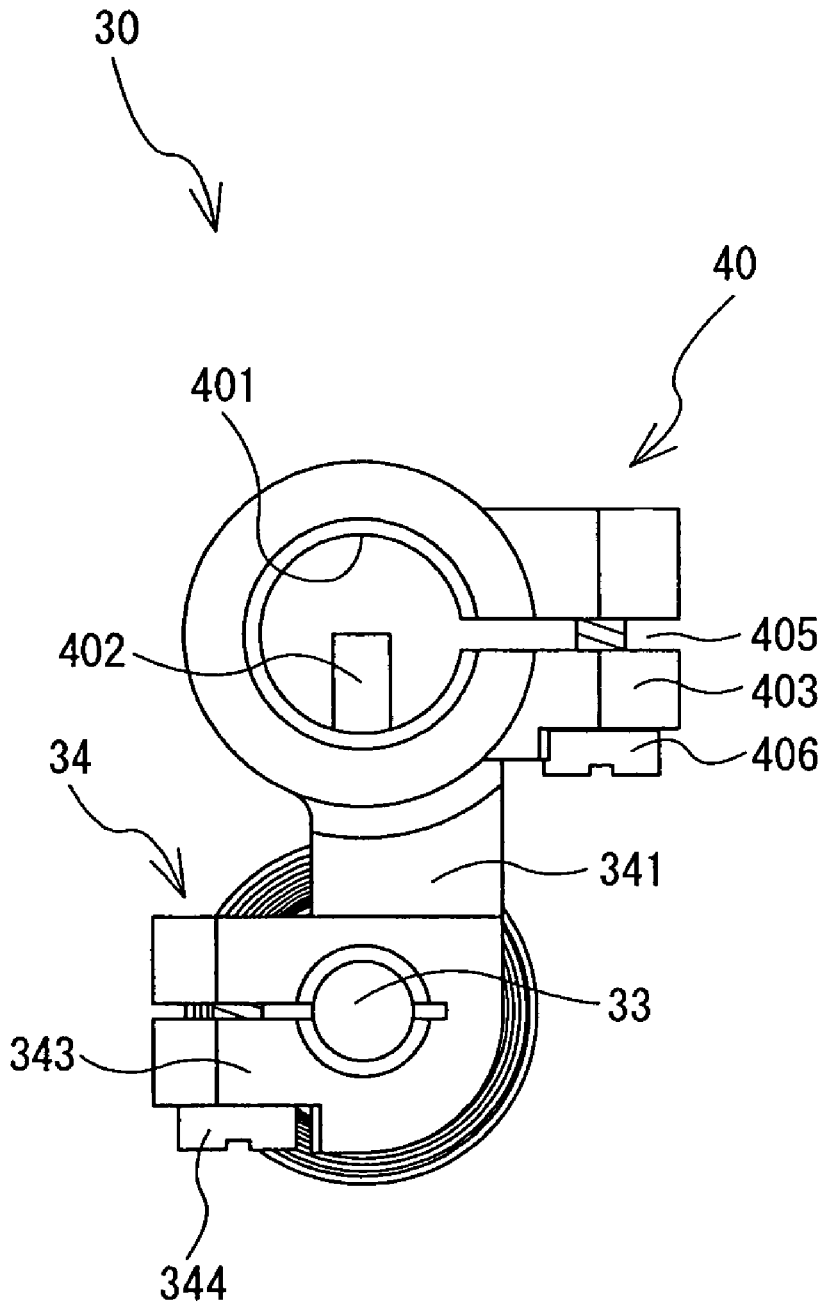
FIG. 10 is a plan view of the boring device.
Figure 11:
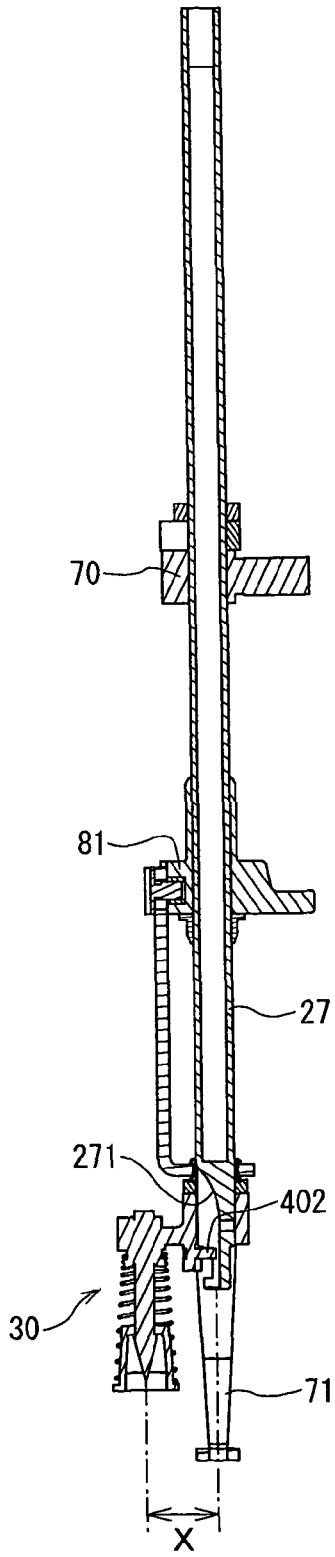
FIG. 11 is a cross-sectional view taken along a line I-I in FIG. 5.
Figure 12:
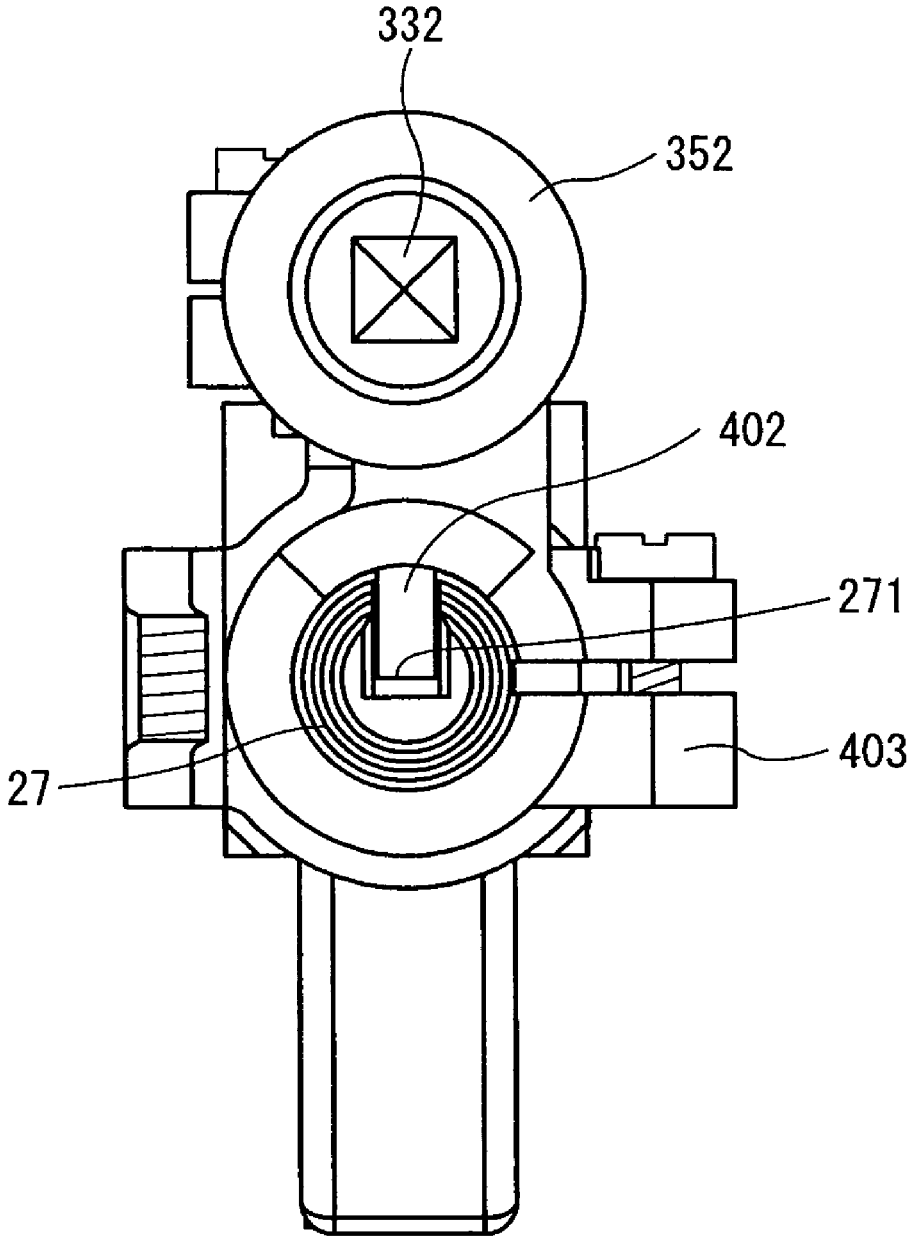
FIG. 12 is a cross-sectional view taken along a line II-II in FIG. 5.

The attachment portion 40 is configured to attach the boring device 30 in a detachable manner to a predetermined needle bar 27 of the multi-needle embroidery sewing machine 11. In the present embodiment, the predetermined needle bar 27 has the needle bar number 1. As shown in FIGS. 7 to 10, the attachment portion 40 includes an engagement hole 401, an engagement projecting portion 402, and a clamping portion 403. The engagement hole 401 is shaped like a cylinder that has an inner circumference somewhat longer than the outer circumference of the needle bar 27, so that the lower end of the needle bar 27 may pass through the engagement hole 401. A slit portion 405 is formed in a part of the engagement hole 401. As shown in FIGS. 9 and 10, an engagement protruding portion 402 having a cylindrical shape is provided below the engagement hole 401 and protrudes toward the center of the engagement hole 401 in a planar view. In a condition where the boring device 30 is attached to the needle bar 27, the engagement protruding portion 402 is engaged with the engagement concave portion 271 of the needle bar 27 as shown in FIGS. 11 and 12.

The clamping portion 403 is configured to fix the boring device 30 to the needle bar 27. Specifically, by tightening a screw 406 so as to decrease the width of the slit portion 405, the internal diameter of the engagement hole 401 is reduced to fix the boring device 30 to the needle bar 27. As shown in FIG. 5, when the boring device 30 is attached to the lower end of the needle bar 27, the clamping portion 403 protrudes rightward from the vertical center line (the line I-I) of the needle bar 27. As shown in FIG. 3, on the right side of the lower end of the needle bar 27 with the needle bar number 1, a space 82 is provided so that the clamping portion 403 may not interfere with the frame 80 when the boring device 30 is attached to the needle bar 27 with the needle bar number 1. On the other hand, on the right side of the lower end of each of the needle bars 27 with the needle bar numbers 2 to 6, the presser foot 71 of its right-hand neighbor needle bar 27 is disposed. Accordingly, if the boring device 30 is attached to the needle bar 27 with any needle bar number other than 1, the clamping portion 403 may interfere with the presser foot 71 of its right-hand neighbor needle bar 27. Thus, the multi-needle embroidery sewing machine 11 of the present embodiment is configured such that the engagement hole 401 (see FIG. 7) cannot be engaged with the lower end of the needle bar 27 with any needle bar number other than 1.

As shown in FIG. 7, the boring knife 33 is held along the vertical direction in an attachment hole 342 via a clamping portion 343. The attachment hole 342 is formed in an arm 341 of the holder 34 that extends leftward in FIG. 7. The boring knife 33 includes a base 331, a cutting portion 332, and a step portion 333. The base 331 constitutes the upper part of the boring knife 33 and is shaped like a round rod. When the upper part of the base 331 is inserted into the attachment hole 342 and the clamping portion 343 is tightened with a screw 344, the boring knife 33 may be fixed to the holder 34. The cutting portion 332 constitutes the lower part of the boring knife 33 and is shaped like an inverted quadrangular pyramid. When the cutting portion 332 is plunged through the work cloth 90, a square eyelet may be formed. Each side of a square that defines the exterior shape of the upper end surface of the cutting portion 332 is a little bit larger than the outer diameter of the base 331. The step portion 333 constitutes a boundary between the base 331 and the cutting portion 332. As shown in FIGS. 4 and 6, when the boring device 30 is attached to the needle bar 27, the horizontal position of the tip of the cutting portion 332 is in front of that of the needle drop point of the sewing needle 19 (see FIG. 1) by the distance X. A plurality of boring knives, each of which has a different shape of the cutting portion 332, may be prepared so that the shape of the cutting portion 332 suitable for the shape of a desired eyelet can be selected. Further, the eyelet size may be appropriately changed by adjusting a vertical position at which the base 331 is to be fixed.

Figure 8:
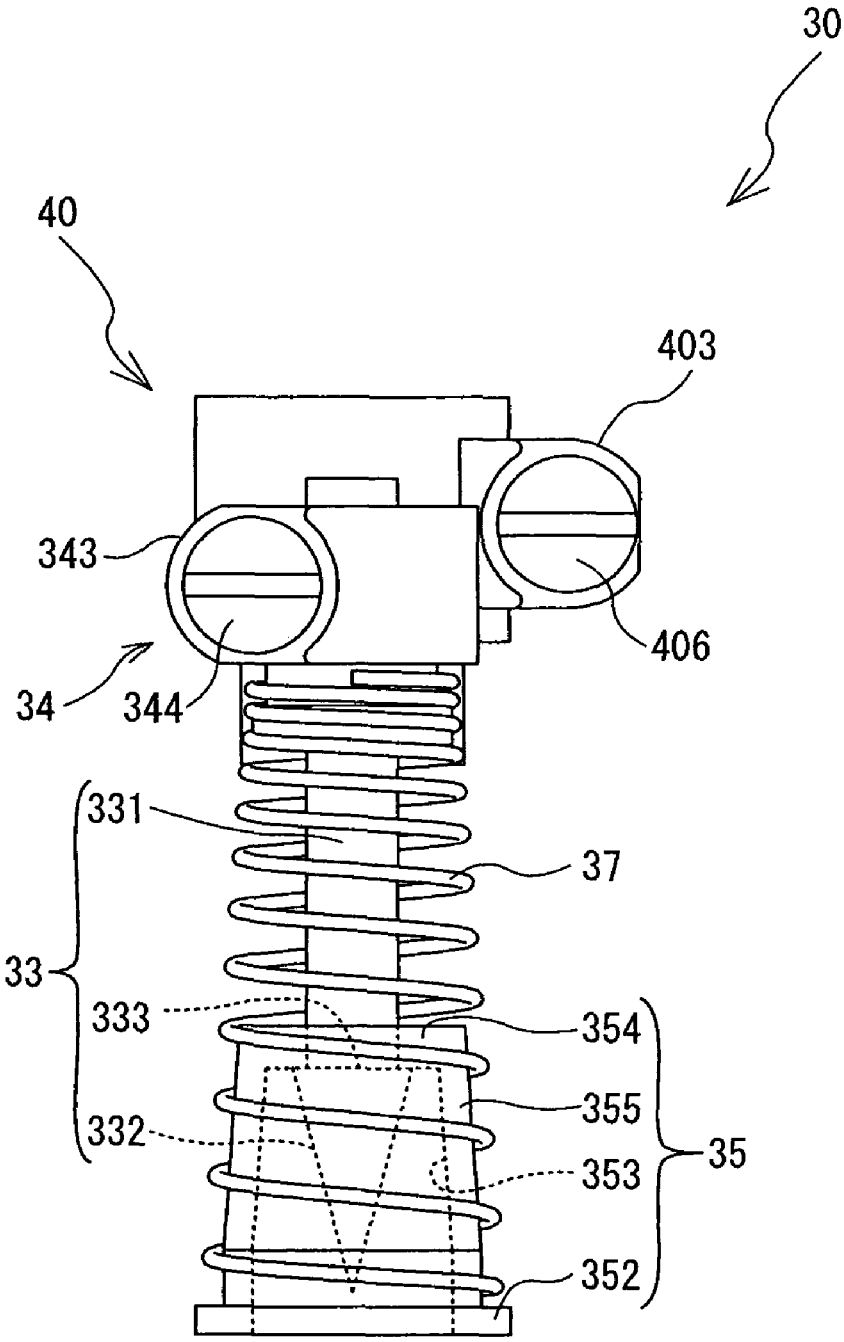
FIG. 8 is a front view of the boring device.

As shown in FIG. 8, the presser 35 includes a side surface 355 having a tapered shape and an upper surface 354 that closes up the upper part of the side surface 355. In the upper surface 354, a circular hole is formed. The base 331 of the boring knife 33 passes through the circular hole, so that the presser 35 is slidably fitted to the boring knife 33. The presser 35 is usually biased by the spring 37 which is disposed on the outer periphery of the presser 35, thus causing the upper surface 354 to touch the step portion 333 of the boring knife 33. Thus, the lowering of the presser 35 is restricted. An annular protrusive portion 352 is provided on the outer periphery of the presser 35 in the vicinity of the lower end of the presser 35. As shown in FIG. 8, a hollow portion 353, which is surrounded by the side surface 355 and the upper surface 354, is provided in the lower part of the presser 35. The hollow portion 353 protects the cutting portion 332 of the boring knife 33 by surrounding the cutting portion 332.

The boring device 30 thus configured may be attached to the needle bar 27 as follows. First, the needle clamp 84 is removed from the lower end of the needle bar 27 with the needle bar number 1. Then, the lower end of the needle bar 27 with the needle bar number 1 is inserted into the engagement hole 401 of the boring device 30. At this time, the engagement protruding portion 402 of the boring device 30 is engaged with the engagement concave portion 271 in the needle bar 27. In a condition where the engagement concave portion 271 and the engagement protruding portion 402 are engaged with each other, the horizontal rotation of the boring device 30 is restricted. The boring knife 33 is positioned with respect to the needle bar 27 so that the horizontal position of the tip of the cutting portion 332 may correspond to the horizontal position of a relief hole 38 (see FIG. 14) formed in a needle plate 28. After the boring device 30 is inserted into a predetermined attachment position, the screw 406 of the clamping portion 403 is tightened to fix the boring device 30 to the needle bar 27.

An operation of forming stitches on a work cloth held by the embroidery frame (not shown) supported by the embroidery frame moving mechanism 18 (see FIG. 2) will be described below with reference to FIGS. 1 to 3. When the needle bar case 15 is moved right and left, one of the six needle bars 27 is selected. A drive shaft 74 is rotationally driven by a sewing machine motor (not shown) and a needle bar drive mechanism (not shown) is driven. The needle bar drive mechanism includes a thread take-up lever drive cam 75, a coupling member 76, a transmission member 77, a guide rod 78, a coupling pin (not shown). The rotational driving force from the drive shaft 74 is transmitted via the thread take-up lever drive cam 75 to the coupling member 76. As a result, the transmission member 77 to which the coupling member 76 is pivotally supported is driven up and down, guided by the guide rod 78 disposed parallel to the needle bar 27. The vertical driving force is transmitted via the coupling pin (not shown) to the needle bar 27, and the needle bar 27 to which the sewing needle 19 is attached is driven up and down. The rotation of the drive shaft 74 is transmitted also to the shuttle drive mechanism (not shown) and the shuttle (not shown) is rotationally driven. In such a manner, the sewing needle 19 and the shuttle are driven in synchronization with each other, to form stitches on the work cloth.

An operation of forming an eyelet based on embroidery sewing data by the boring device 30 that is attached to the needle bar 27 with the needle bar number 1 will be described below with reference to FIGS. 1, 2, 13 and 14. First, the needle bar case 15 is moved right and left and the needle bar 27 with the needle bar number 1, to which the boring device 30 is attached, is selected. Then, the drive shaft 74 is rotationally driven by the sewing machine motor (not shown) to drive the needle bar drive mechanism (not shown), thereby the needle bar 27 is lowered. When the needle bar 27 is lowered, the presser 35 and the boring knife 33 are also lowered.

Figure 14:
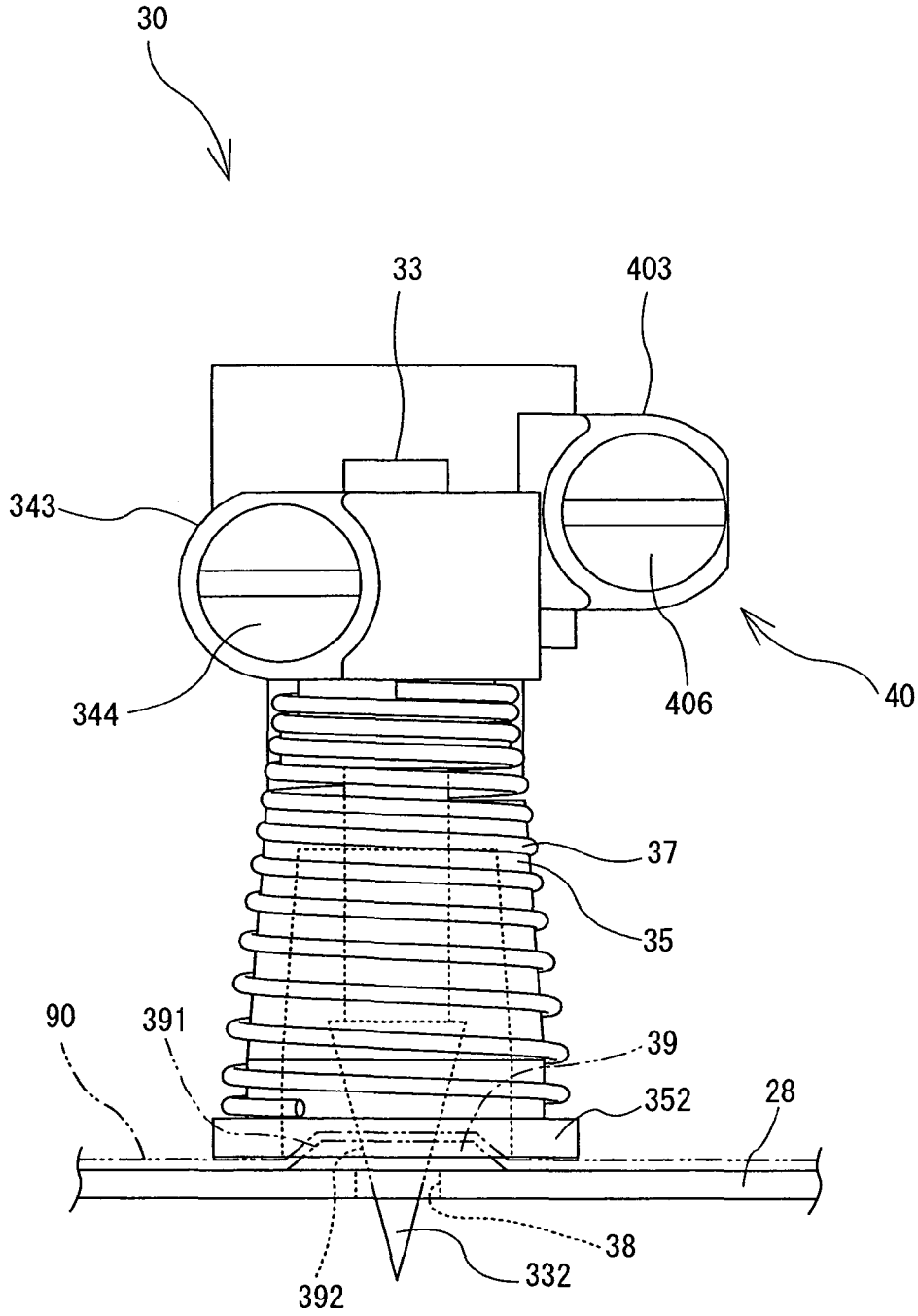
FIG. 14 is a front view of the boring device in the condition where the spring is compressed.

As shown in FIG. 14, the needle plate 28 is provided with the relief hole 38, into which the cutting portion 332 of the boring knife 33 may be plunged. A grip plate 39 is attached to the upper surface of the needle plate 28 around the relief hole 38. The grip plate 39 annularly grips a portion where the eyelet is to be formed on the work cloth 90, in cooperation with the presser 35. The grip plate 39 may be made of an elastic material, such as rubber and synthetic resin, and molded into the shape of a disk. A tapered grip surface 391 is formed at the rim of the grip plate 39. At the midsection of the grip plate 39, a through-hole 392 is formed in a shape similar to the shape of the cutting portion 332 of the boring knife 33, so that the cutting portion 332 may be plunged into the through-hole 392 in close contact with the through-hole 392. For simplification, FIG. 1 does not show the needle hole or the relief hole 38 in the needle plate 28.

Figure 13:
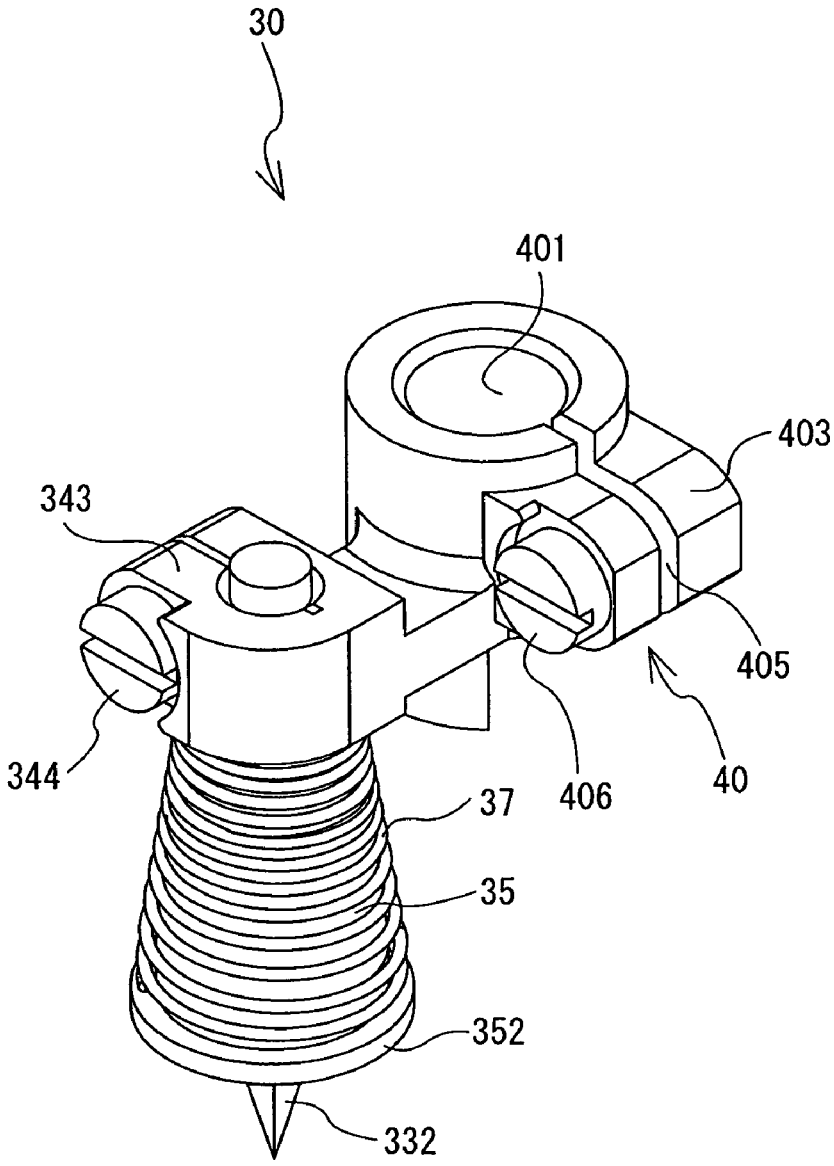
FIG. 13 is a perspective view of the boring device in a condition where a spring is compressed.

When the needle bar 27 is lowered, the protrusive portion 352 of the presser 35 contacts the work cloth 90 which is placed on the upper surface of the needle plate 28. If the needle bar 27 is lowered further, as shown in FIGS. 13 and 14, the spring 37 is compressed to press the presser 35 downward, so that the work cloth 90 is annularly sandwiched between the lower end of the protrusive portion 352 and the grip plate 39 under pressure. Simultaneously, the cutting portion 332 of the boring knife 33 is lowered below the protrusive portion 352 of the presser 35 and plunged through the sandwiched work cloth 90, thus plunged into the through-hole 392 and the relief hole 38. Thus, an eyelet is formed in the work cloth 90.

As detailed above, according to the boring device 30 and the multi-needle embroidery sewing machine 11 equipped with the same of the present embodiment, the engagement concave portion 271, which is provided in the lower end of the needle bars 27, and the engagement protruding portion 402, which is provided on the boring device 30, can be used to horizontally position the boring device 30 with respect to the predetermined needle bar 27. Accordingly, engaging the engagement concave portion 271 and the engagement protruding portion 402 with each other may make it unnecessary for the user to adjust the position of the boring knife 33 with respect to the needle bar 27. Further, in the present embodiment, the engagement protruding portion 402 is provided below the engagement hole 401. Therefore, the position of the engagement protruding portion 402 may be adjusted in a condition where the lower end of the needle bar 27 is inserted into the engagement hole 401, thus easily engaging the engagement protruding portion 402 and the engagement concave portion 271 with each other. Thus, it may be possible for the user to easily and appropriately attach the boring device 30 to the predetermined needle bar 27 of the multi-needle embroidery sewing machine 11.

Further, in the present embodiment, the engagement concave portion 271 formed in the lower end of the needle bar 27 functions as an insertion hole through which the sewing needle 19 is inserted and also as a positioning member that horizontally positions the boring device 30. Therefore, it may be unnecessary to newly provide a horizontal positioning member for positioning when the boring device 30 is attached to the needle bar 27.

Further, if the user tries to attach the boring device 30 to the needle bar 27 having a needle bar number other than 1, the clamping portion 403 of the boring device 30 may interfere with the presser foot 71 of the multi-needle embroidery sewing machine 11. Therefore, the boring device 30 may be attached to only needle bar 1 of the needle bars 27. Thus, it may be possible to surely avoid the risk of mistakenly attaching the boring device 30 to any needle bar 27 other than that having the needle bar number 1.

The present disclosure is not limited to the above-detailed embodiment and may be modified variously within the scope intended by the present disclosure. For example, it may be modified appropriately as described below.

The multi-needle embroidery sewing machine 11 of the above-described embodiment has six needle bars. However, the number of the needle bars can be changed appropriately as far as the number is at least two. Also, the physical configuration of the multi-needle embroidery sewing machine 11 may be modified appropriately.

In the multi-needle embroidery sewing machine 11 of the above-described embodiment, the presser foot 71 functions as an interference member that interferes with the clamping portion 403 of the boring device 30. However, any member other than the presser foot 71 may be disposed as the interference member. For example, the needle clamp 84 shown in FIGS. 2 and 3 may be used as the interference member. Also, in a case where the engagement concave portion 271 is formed only in the predetermined needle bar 27, the boring device 30 can be mounted only to the predetermined needle bar 27 even without providing the interference member. In this case, a hole may be formed in the needle clamp 84 through which the sewing needle 19 may be inserted. The shape and the configuration of the attachment portion 40 may also be changed appropriately.

In the above-described embodiment, the engagement concave portion 271 formed in the lower end of the needle bar 27 and the engagement protruding portion 402 of the boring device 30 are configured to be engaged with each other. However, the configurations and the shapes of the engagement concave portion 271 and the engagement protruding portion 402 are not limited to those of the above-described embodiment, as far as the horizontal movement of the boring device 30 can be restricted when the engagement concave portion 271 and the engagement protruding portion 402 are engaged with each other. For example, one of the engagement concave portion 271 and the engagement protruding portion 402 may be shaped like a hook while the other may be shaped like a loop-shaped ring. Further, for example, a protruding portion may be formed on the needle bar 27 and a concave portion may be formed in the boring device 30 to be engaged with the protruding portion. In such a manner, in a case where a pair of engagement portions is constituted by a protruding portion and a concave portion, the shapes of the protruding and concave portions may be changed appropriately.

Figure 15:
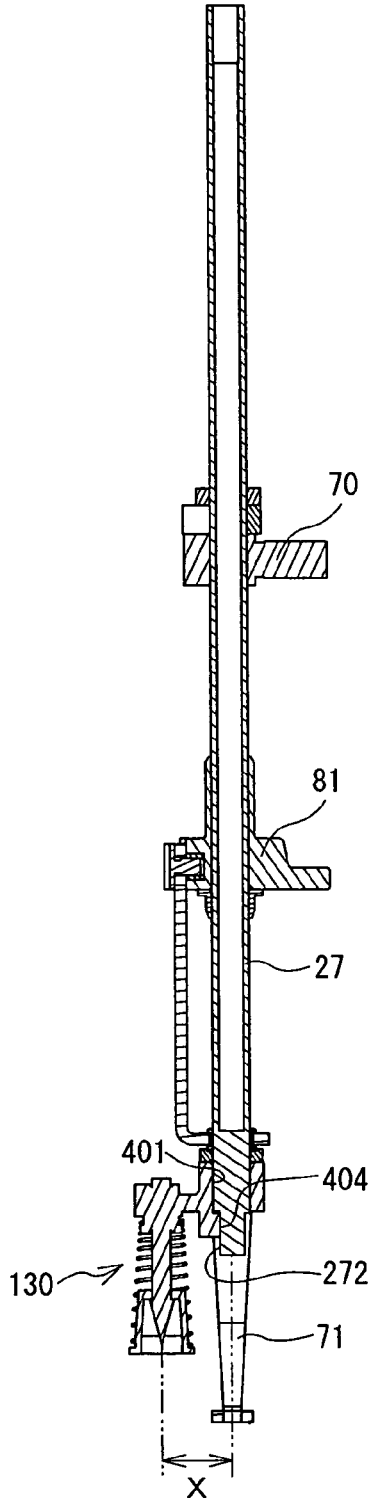
FIG. 15 is across-sectional view of a boring device according to a modified example, taken along a line corresponding to the line I-I in FIG. 5.
Figure 16:
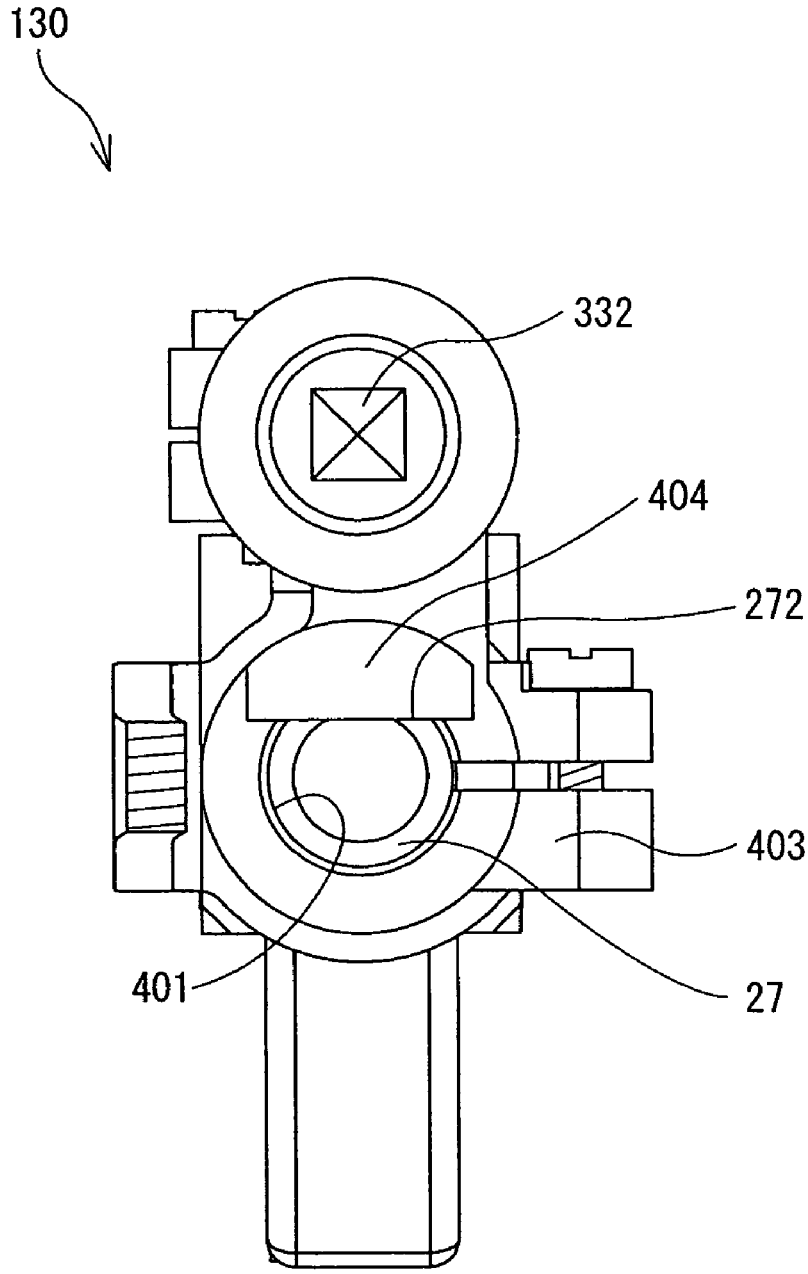
FIG. 16 is a cross-sectional view of the boring device according to the modified example, taken along a line corresponding to the line II-II in FIG. 5.

For example, the pair of engagement portions may be shaped as shown in FIGS. 15 and 16. As shown in FIGS. 15 and 16, an engagement concave portion 272 formed in the needle bar 27 is shaped like a cylinder notched partially in bottom plan view. An engagement protruding portion 404 formed on the boring device 30 is positioned below the engagement hole 401 and shaped like a circle notched partially in bottom plan view so that the engagement protruding portion 404 may be engaged with the engagement concave portion 272. It should be noted that in this example, an insertion hole is formed in the needle clamp 84 so as to enable the sewing needle 19 to be inserted therethrough and fixed therein.

What is claimed is:

1. A multi-needle embroidery sewing machine comprising:

a plurality of needle bars;

a second engagement portion provided on a predetermined needle bar of the plurality of needle bars; and a detachable boring device that is attached to a lower end of the predetermined needle bar, wherein:

the boring device comprises a boring knife that makes a cut in a work cloth and a first engagement portion that is engaged with the second engagement portion;

the second engagement portion restricts horizontal rotation of the boring device;

a horizontal position of the boring knife with respect to the predetermined needle bar is determined when the first engagement portion is engaged with the second engagement portion;

the boring device further comprises an attachment portion configured to fix the boring device to the lower end of the predetermined needle bar; and the multi-needle embroidery sewing machine further comprises an interference member that interferes with the attachment portion when the boring device is attached to the lower end of a needle bar other than the predetermined needle bar, thereby restricting the attachment of the boring device to the needle bar other than the predetermined needle bar.

2. The multi-needle embroidery sewing machine as claimed in claim 1, wherein the interference member is at least one of a needle clamp and a presser foot, the needle clamp being disposed to the lower end of each of the plurality of needle bars and having a sewing needle attached, and the presser foot holding the work cloth intermittently in conjunction with vertical movements of each of the plurality of needle bars.

* * * * *